US006364443B1

(12) United States Patent
Katano et al.

(10) Patent No.: US 6,364,443 B1
(45) Date of Patent: Apr. 2, 2002

(54) THERMAL PRINTER AND RECORDING METHOD THEREOF

(75) Inventors: Keiji Katano; Kazuhiko Hiratsuka, both of Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/543,839

(22) Filed: Apr. 5, 2000

(30) Foreign Application Priority Data

Apr. 6, 1999 (JP) ..... 11-099282
Apr. 9, 1999 (JP) ..... 11-102484
Sep. 10, 1999 (JP) ..... 11-256859

(51) Int. Cl.[7] ..... B41J 29/38
(52) U.S. Cl. ..... 347/9; 347/10; 347/11
(58) Field of Search ..... 347/9, 10, 17, 347/19

(56) References Cited

U.S. PATENT DOCUMENTS 5,170,416 A 12/1992 Goetz et al. ..... 377/17
5,427,461 A * 6/1995 Hirai et al. ..... 400/279

FOREIGN PATENT DOCUMENTS

EP 0 514 038 A2 11/1992 ..... B41J/19/20
EP 0 581 403 A2 2/1994 ..... B41J/33/36
EP 0 664 221 A2 7/1995 ..... B41J/19/18
EP 0 694 393 A1 1/1996 ..... B41J/2/05
JP 57-84877 5/1982 ..... B41J/3/20

* cited by examiner

*Primary Examiner*—John Barlow
*Assistant Examiner*—Alfred Dudding
(74) *Attorney, Agent, or Firm*—Brinks Hofer Gilson & Lione

(57) ABSTRACT

The invention provides a thermal printer and a recording method of the thermal printer that are capable of reducing the recorded density non-uniformity (jitter) and obtaining a good quality recorded image. The period of the pulse signal generated by an encoder is measured, at least one of the applied voltage and the current flow time of the head pulse is operated based on the difference between the measured value and the theoretical value measured by the encoder, and the head pulse is controlled based on the arithmetic value. Otherwise, the duty ratio of the output time to the non-output time of the pulse signal generated by the encoder is measured, the output correction time of the OFF head pulse is operated based on the duty ratio, and the OFF head pulse is supplied to the heater elements at the time point that delayed by the output correction time from the output ending time of the pulse signal.

20 Claims, 8 Drawing Sheets

THERMAL PRINTER AND RECORDING METHOD THEREOF

BACKGROUND OF THE INVENTION

1. Field of the Invention

This invention relates to a thermal printer and a recording method thereof, and more particularly relates to a thermal printer and a recording method thereof provided with an encoder that detects a linear scale marker when a carriage having a thermal head is moved to generate pulse signals intermittently and provided with a control unit that generates and supplies a head pulse corresponding to the pulse signal generated by the encoder to the heater elements of the thermal head.

2. Description of the Related Art

In the technical field of the thermal printer provided with a carriage having a thermal head on which a plurality of heater elements are arranged that controls heating of the thermal head to thereby print a record composed of an aggregate of dots on a recording paper, various modifications have been introduced so that recording is performed on a printing paper by the thermal head with a constant dot pitch regardless of fluctuation in the moving speed of the carriage.

In detail, the thermal printer is provided with the carriage on which a thermal head is mounted having a plurality of heater elements, and the carriage is supported slidably so as to be reciprocated along a platen. Near the platen, a long linear scale comprising markers and blanks having the same length are formed alternately and continuously along the platen. The liner scale is provided in parallel to the platen.

At the position that is facing the linear scale of the carriage, an encoder for detecting the marker of the linear scale when the carriage is moved is provided. The encoder is provided with a light emitting element for emitting a light onto the linear scale and a light receiving element for detecting the light reflected on the marker.

The marker is reflective in nature, and the encoder detects the marker by detecting the reflected light from the marker when the encoder moves to the position of the marker. The encoder generates the detection result of the marker as a pulse signal.

On the other hand, the blank is transparent in nature, and the encoder does not detect the blank. The encoder does not generate a pulse signal when the encoder moves to the position of the blank.

The thermal printer is provided with a memory for storing the encoder signal that is the pulse signal generated by the encoder.

Furthermore, the thermal printer is provided with a control unit for generating and supplying the head pulse that is synchronous with the pulse signal to the heater elements of the thermal head.

Otherwise, the thermal printer is provided with a control unit for generating and supplying the head pulse composed of ON head pulse that is synchronous with the output starting timing of the pulse signal and OFF head pulse that is synchronous with the output ending timing of the pulse signal to the heater elements of the thermal head.

In the case that the conventional thermal printer having the structure described herein above is used recording, when the thermal printer is fabricated or before recording, at first the carriage is moved from the left end to the right end of the platen and the encoder detects the marker of the linear scale. At that time, the encoder generates the pulse signal intermittently every time when the maker (refer to the upper diagram in FIG. 12) is detected. Pulse signals generated intermittently by the encoder are components of a series of encoder pulse signal as shown in the middle diagram in FIG. 12.

The length of each marker of the linear scale shown in the upper diagram of FIG. 12 is formed of a constant interval and is read in a short time if the moving speed of the carriage is fast. On the other hand, the length of the marker is read in a long time if the moving speed of the carriage is slow. As the result, the length of the marker is represented in the form of the difference in the length of the output pulse signal.

The pulse signal generated by the encoder is stored in the memory.

Next, when the thermal printer is used for recording, the control unit reads out the pulse signal data from the encoder.

As shown in the lower diagram of FIG. 12, the head pulse that is synchronized with the pulse signal read out by the control unit is supplied to the heater elements of the thermal head.

As the result, even though the moving speed of the carriage fluctuates as shown with a broken line in FIG. 13 from a constant speed v (referred to as theoretical speed hereinafter) shown with a solid line in FIG. 13, the output timing of the head pulse is synchronized with the output timing of the pulse signal of the encoder.

As described herein above, even though the moving speed of the carriage fluctuates, the dot scattering or overlapping will not occur from the theoretical view point because each dot pitch P recorded by the thermal head can be equalized to the length of one marker of the linear scale. Using the method described herein above, a recorded image of good quality with reduced recording density non-uniformity (so-called jitter) caused in the recording direction is obtained.

However, in the conventional thermal printer, the applied voltage V and the current flow time W of the head pulse are the same for all head pulses. Furthermore, the moving speed of the carriage and the recorded density are in the negatively proportional relation as shown in FIG. 14, and the moving speed of the carriage and the recorded area are in the positively proportional relation as shown in FIG. 15.

As the result, as shown in FIG. 16, the recorded area of one dot recorded at the recording position where the moving speed of the carriage is faster than the theoretical speed is larger than the recorded area of one dot (referred to as theoretical recorded area hereinafter) recorded at the recording position where the moving speed of the carriage is equal to the theoretical speed, and the recorded density of one dot recorded at the recording position where the moving speed of the carriage is faster than the theoretical speed is lower than the recorded density of one dot (referred to as theoretical recorded density hereinafter) recorded at the recording position where the moving speed of the carriage is equal to the theoretical speed. On the other hand, the recorded area of one dot recorded at the recording position where the moving speed of the carriage is slower than the theoretical speed is smaller than the theoretical recorded area, and the recorded density of one dot is higher than the theoretical recorded density.

The recorded area and the recorded density can not be equalized at all the recording positions and jitter can not be removed perfectly, and the recorded image of good quality can not be obtained disadvantageously.

An another conventional thermal printer, in which the head pulse that is synchronized with the output starting time and the output ending time of the pulse signal read out by the control unit is supplied to the heater elements of the thermal head with motion of the carriage along the platen, has been known.

In this case, for the purpose of convenience, the time point shown with A in the upper diagram of FIG. 17 is assumed to be the output starting time of the pulse signal and the time point shown with B in the upper diagram of FIG. 17 is assumed to be the output ending time of the pulse signal. The length of each marker of the linear scale shown in the middle diagram of FIG. 17 is the relative length viewed from the encoder. In detail, because the encoder reads one marker in a shorter time at the position where the speed of the carriage is fast, the length of the marker is shorter. On the other hand, because the encoder reads one marker in a longer time at the position where the speed of the carriage is slow, the length of the marker is longer.

In the conventional thermal printer, due to various causes such as the accuracy of the linear scale, the accuracy of a light emitting diode light source of the encoder, and the positional accuracy of the encoder and the linear scale, the discrepancy between the output time $T_{ON}$ and the non-output time $T_{OFF}$ of the pulse signal as shown in the upper diagram of FIG. 18 is a problem even when the moving speed of the carriage is constant, in other words, when the resolution of the output is to be doubled by using both starting and ending signals, unlike the case in which only the starting signal of the encoder is used, the signal accuracy becomes poor.

To solve the problem, a current is supplied to the heater elements by means of the head pulse based on both starting and ending of the encoder signal. However, the print dot pitch P is not constant as shown in the lower diagram of FIG. 18 and jitter is caused, and the problem is not solved.

The ratio of the output time $T_{ON}$ and the non-output time $T_{OFF}$ of one pulse of the pulse signal under an assumption that the moving speed of the carriage is constant is called generally as duty ratio. It has been known from the statistical data of all encoder signals that the $T_{ON}$ and $T_{OFF}$ tend to exhibit normal distributions having respective average values different from each other. In detail, as shown in FIG. 19, $T_{ON}$ and $T_{OFF}$ tend to converge to consistent average values such as 40% and 60% respectively based on the total of $T_{ON}$ and $T_{OFF}$ of 100%. Accordingly, the duty ratio $T_{ON}/T_{OFF}$ converges to a consistent value for all pulse signals.

SUMMARY OF THE INVENTION

It is an object of the present invention to provide a thermal printer and a recording method of the thermal printer that are capable of obtaining the recorded image of good quality with no jitter by means of a method in which the head pulse is synchronized with the pulse signal generated by an encoder and at least one of the applied voltage and the current flow time of the head pulse is controlled.

In detail, the thermal printer of the present invention is provided with a control unit having an arithmetic unit for operating at least one of the applied voltage and the current flow time of the head pulse based on the difference between the theoretical value and the measured value of the pulse signal, and controls the head pulse based on at least one of the applied voltage and the current flow time operated by the arithmetic unit.

Another object of this invention is to control the thermal printer so that the applied voltage of the head pulse is increased and/or the current flow time of the head pulse is shortened at the recording position where the moving speed of the carriage is faster, and on the other hand, the applied voltage of the head pulse is decreased and/or the current flow time of the head pulse is extended.

Furthermore, the thermal printer of the present invention is characterized in that the control unit controls at least one of the applied voltage and the current flow time of the (N+1)-th head pulse based on the error of the N-th pulse signal.

Another object of this invention is to provide a method in which the encoder detects the marker and the control unit generates the head pulse simultaneously.

Furthermore, the recording method of the thermal printer of the present invention is characterized in that at least one of the applied voltage and the current flow time of the head pulse is operated based on the difference between the theoretical value and the measured value of the period of the pulse signal and the head pulse is controlled based on at least one of the applied voltage and the current flow time operated as described herein above.

Another object of this invention is to control the thermal printer so that the applied voltage of the head pulse is increased and/or the current flow time of the head pulse is shortened at the recording position where the moving speed of the carriage is faster, and on the other hand, the applied voltage of the head pulse is decreased and/or the current flow time of the head pulse is extended at the recording position where the moving speed of the carriage is slower.

Furthermore, the recording method of the thermal printer of the present invention is characterized in that at least one of the applied voltage and the current flow time of the (N+1) -th head pulse is controlled based on the error of the N-th pulse signal.

Another object of this invention is to provide a method in which the encoder detects the marker and the head pulse is generated simultaneously.

Another object of this invention is to provide the thermal printer and the recording method of the thermal printer that are capable of obtaining a good quality image with reduced jitter by performing correction in which the output time of the head pulse to be supplied to the heater elements is delayed by a predetermined time from the output starting time or the output ending time of the pulse signal generated from the encoder to correct the time error caused in the encoder.

In detail, the thermal printer of the present invention is characterized in that the thermal printer is provided with a measurement unit for measuring the duty ratio of the output time to the non-output time of the pulse signal generated by the encoder and an output correction time arithmetic unit for operating the output correction time of the OFF head pulse based on the duty ratio measured by the measurement unit, and the control unit generates and supplies the OFF head pulse at the time point that is delayed by the output correction time from the output ending time of the pulse signal to the heater elements.

Another object of this invention is to provide a good quality image having a constant dot pitch by correcting the output timing of the head pulse to compensate the time error caused in the encoder even if the resolution of the encoder is doubled.

The thermal printer of the present invention is characterized in that the thermal printer is provided with a measurement unit for measuring the duty ratio of the output time to the non-output time of the pulse signal generated by the encoder and the output correction time arithmetic unit for operating the output correction time of the ON head pulse based on the duty ratio measured by the measurement unit, and the ON head pulse is generated and supplied at the timing that is delayed by the output correction time from the output starting time of the pulse signal to the heater elements.

It is the object of the present invention to provide the image of good quality having a constant dot pitch by correcting the output timing of the head pulse to compensate the time error caused in the encoder even if the resolution of the encoder is doubled.

The recording method of the thermal printer of the present invention is characterized in that the duty ratio of the output time to the non-output time of the pulse signal generated by the encoder is measured, the output correction time of the OFF head pulse is operated based on the measured duty ratio, and the OFF head pulse is supplied to the heater elements at the time point that is delayed by the output correction time from the output ending time of the pulse signal.

It is the object of this invention to provide the image having a constant dot pitch by correcting the output timing of the head pulse to compensate the time error caused in the encoder even if the resolution of the encoder is doubled.

The recording method of the thermal printer of the present invention is characterized in that the duty ratio of the output time and the non-output time of the pulse signal generated by the encoder is measured, the output correction time of the ON head pulse is operated based on the measured duty ratio, and the ON head pulse is supplied to the heater elements at the time point that is delayed by the output correction time from the output starting time of the pulse signal.

DETAILED DESCRIPTION OF THE PREFERRED EMBODIMENTS

Figure 1:
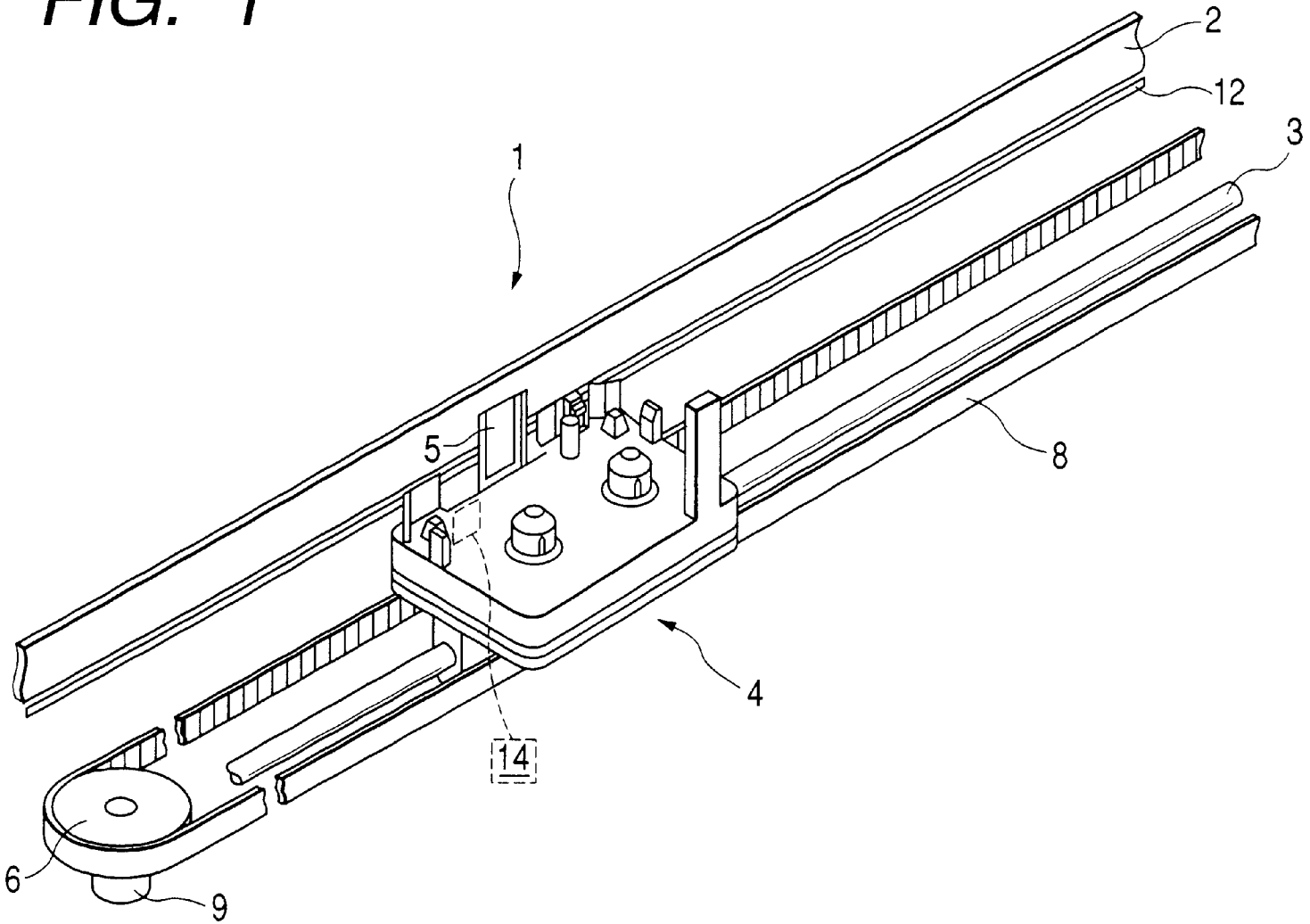
FIG. 1 is a perspective view for illustrating the first embodiment of a thermal printer in accordance with the present invention.

The first embodiment of the present invention will be described in detail hereinafter with reference to FIG. 1 to FIG. 5. A thermal printer 1 in the present embodiment is provided with a platen 2 having a shape of long plate shown in FIG. 1 at the desired position on a frame not shown in the drawing. Under the front of the platen 2, a carriage shaft 3 that is disposed in parallel to the platen 2 is provided, and the carriage 4 is supported movably so as to reciprocate along the platen 2 by the carriage shaft 3. A thermal head 5 on which a plurality of heater elements are arranged is provided so as to be on/off contactable on the platen 2 at the position of the carriage 4 that faces to the platen 2. A driving belt 8 strung between a pair of pulleys 6 is fixed to one end of the carriage, and the driving belt 8 is structured so as to drive the carriage 4 along the platen 2 by means of the driving force of a carriage motor 9 such as a stepping motor connected to the pulleys. Behind the platen 2, a feeding means not shown in the drawing for feeding a recording paper between the platen 2 and the thermal head 5 is provided.

Figure 2:
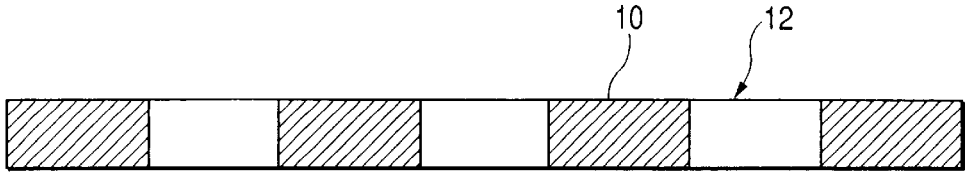
FIG. 2 is a diagram for illustrating a linear scale of the first embodiment of the thermal printer in accordance with the present invention.

Under the platen 2, the linear scale 12 on which a plurality of markers are formed with a plurality of predetermined intervals along the platen 2 shown in FIG. 2 is provided in parallel to the platen 2.

The encoder 14 for detecting a marker 10 of the linear scale 12 and generating the detection result as a pulse signal is provided on the carriage 4. The encoder 14 is provided with a light emitting element, not shown in the drawing, for emitting a light onto the linear scale 12 and a light receiving element, not shown in the drawing, for receiving a light reflected on the marker 10.

Figure 3:
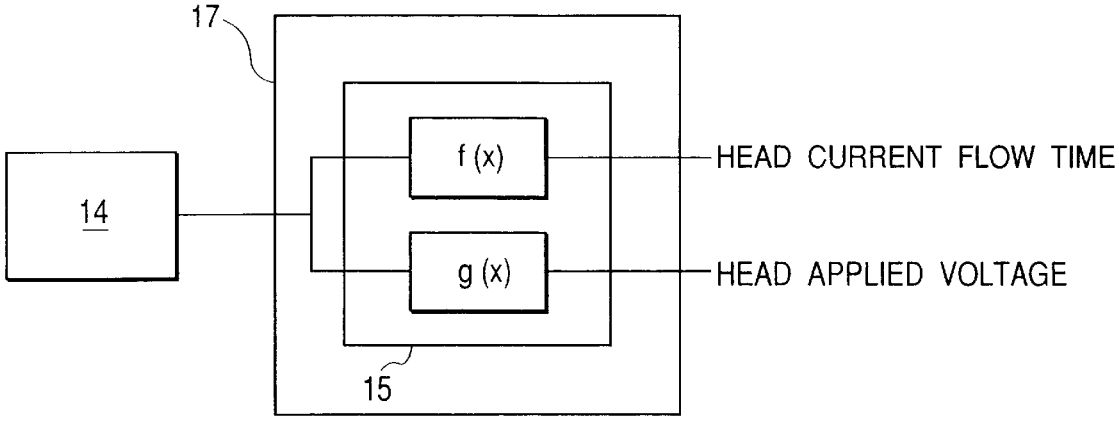
FIG. 3 is a block diagram for illustrating a control system for controlling the head pulse in the first embodiment of the thermal printer in accordance with the present invention.

As shown in FIG. 3, The encoder 14 is connected to a control unit 17 for controlling the applied voltage and current flow time of a head pulse based on a pulse signal generated by the encoder 14. The control unit 17 is provided with an arithmetic unit 15 for operating the current flow time of a current to be supplied to the thermal head by means of a control function f(X) and the applied voltage by means of another control function g(X). The arithmetic unit 15 operates the difference between the theoretical value and measured value of the period of the N-th pulse signal (N denotes an arbitrary natural number (the same hereinafter)), and operates the applied voltage and current flow time of the (N+1)-th head pulse based on the operated difference.

Therefore, the control unit 17 controls the applied voltage and current flow time of the (N+1)-th head pulse based on the difference between the theoretical value and the measured value of the period of the N-th pulse signal.

Next, a recording method of the thermal printer 1 in accordance with the present invention to which the thermal printer 1 is applied.

First, the carriage 4 is positioned at the left end of the platen 2 in the initial condition.

Next, a carriage motor 9 is driven to move the carriage 4 toward right along the platen 2 and to drive the encoder 14 to detect the marker 10 of the linear scale.

Figure 4:
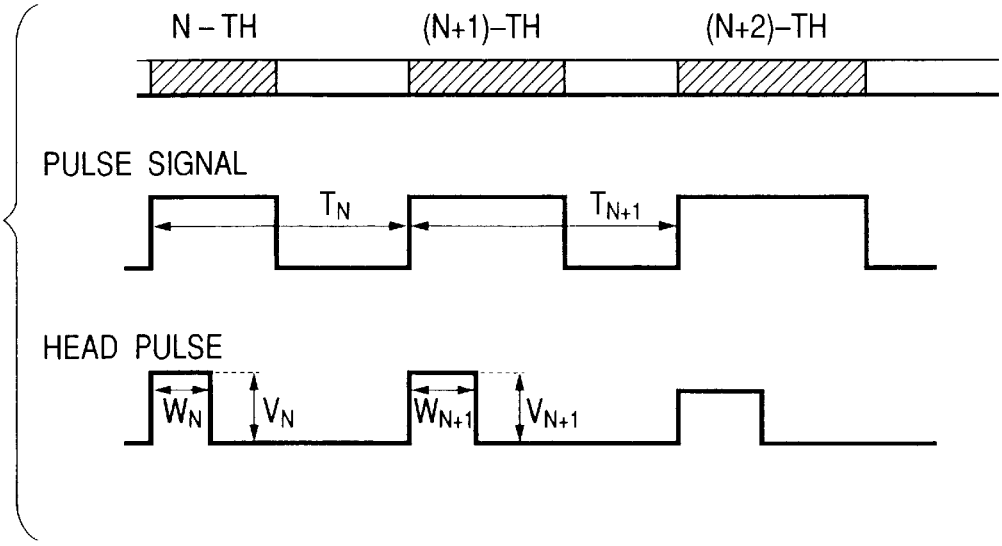
FIG. 4 is a time chart for describing the relation between the pulse signal and head pulse of the encoder in the first embodiment of the thermal printer in accordance with the present invention.

When the encoder 14 detects the N-th marker 10 of the linear scale shown in the upper diagram of FIG. 4, the encoder 14 generates the N-th pulse signal shown in the middle diagram of FIG. 4. The N-th pulse signal generated by the encoder 14 is supplied to the arithmetic unit 15.

Upon receiving the N-th pulse signal, the arithmetic unit 15 operates the difference $T-T_N$ between the theoretical value T and the measured value $T_N$ of the period of the N-th pulse.

Furthermore, the arithmetic unit 15 operates an applied voltage $V_{N+1}$ and a current flow time $T_{N+1}$ of the (N+1)-th head pulse based on the difference $T-T_N$ of the N-th pulse signal.

It is ideal essentially to control the applied voltage $V_{N+1}$ and the current flow time $W_{N+1}$ based on the period $T_{N+1}$ of the (N+1)-th pulse signal at (N+1)-th recording position. However, in the present embodiment, in order to perform both the detection of a marker 10 by the encoder 14 and the generation of the head pulse by the control unit 17 simultaneously, the applied voltage $V_{N+1}$ and the current flow time $W_{N+1}$ of the (N+1)-th head pulse are controlled based on the period $T_N$ of the N-th pulse signal as represented by equations (1) and (2) described hereinafter because the motion characteristic of the carriage 4 at the N-th recording position is regarded to be the same as the motion characteristic of the carriage 4 at the (N+1)-th recording position.

The applied voltage $V_{N+1}$ of the (N+1)-th head pulse is operated according to the equation described herein under.

$$V_{N+1}=V+(T-T_N)\times\alpha \qquad \text{equation (1)}$$

wherein $\alpha$ denotes a positive coefficient, and V denotes a theoretical applied voltage value of the head pulse (referred to as theoretical applied voltage hereinafter).

The current flow time $W_{N+1}$ of the (N+1)-th head pulse is operated according to the equation described herein under.

$$W_{N+1}=W+(T_N-T)\times\alpha \qquad \text{equation (2)}$$

wherein $\alpha$ denotes a positive coefficient, and W denotes a theoretical current flow time value of the head pulse (referred to as theoretical current flow time hereinafter).

The arithmetic unit 15 supplies the applied voltage $V_{N+1}$ and the current flow time $W_{N+1}$ data controlled according to the equations (1) and (2) to the control unit 17.

The control unit 17 receives the (N+1)-th head pulse data supplied from the arithmetic unit 15 and supplies the head pulse of the applied voltage $V_{N+1}=V+(T-T_N)\times\alpha$ and current flow time $W_{N+1}=W+(T_N-T)\times\alpha$ to the heater elements of the thermal head 5.

In the case of $T>T_N$ namely the case in which the period $T_N$ (measured value) of the N-th pulse signal is smaller than the theoretical value T of the pulse signal in the equations (1) and (2), the moving speed of the carriage 4 at the N-th recording position is faster than the theoretical speed. The result that the moving speed of the carriage 4 at the N-th recording position is faster than the theoretical speed indicates that the recorded area at the N-th recording position is larger than the theoretical recorded area and the recorded density at the N-th recording position is lighter than the theoretical recorded density. If $T>T_N$, then $V_{N+1}>V$, and $W_{N+1}<W$. In detail, at the (N+1)-th recording position located adjacent to the N-th recording position, the applied voltage $V_{N+1}$ of the head pulse is controlled so as to be larger than the theoretical applied voltage V, and the current flow time $W_{N+1}$ of the head pulse is controlled so as to be shorter than the theoretical current flow time W.

On the other hand, In the case of $T<T_N$ namely the case in which the period $T_N$ (measured value) of the N-th pulse signal is larger than the theoretical value T of the pulse signal in the equations (1) and (2), the moving speed of the carriage 4 at the N-th recording position is slower than the theoretical speed. The result that the moving speed of the carriage 4 at the N-th recording position is slower than the theoretical speed indicates that the recorded area at the N-th recording position is smaller than the theoretical recorded area and the recorded density at the N-th recording position is deeper than the theoretical recorded density. If $T<T_N$, then $V_{N+1}<V$, and $W_{N+1}>W$. In detail, at the (N+1)-th recording position located adjacent to the N-th recording position, the applied voltage $V_{N+1}$ of the head pulse is controlled so as to be smaller than the theoretical applied voltage V, and the current flow time $W_{N+1}$ of the head pulse is controlled so as to be longer than the theoretical current flow time W.

As the result, the recorded density becomes approximately equal to the theoretical recorded density and the recorded area becomes approximately equal to the theoretical recorded density at the (N+1)-th recording position.

As shown in the middle diagram of FIG. 4, when the control unit 17 generates the (N+1)-th head pulse, the encoder 14 detects the (N+1)-th marker 10 and generates the (N+1)-th pulse signal simultaneously.

Figure 5:
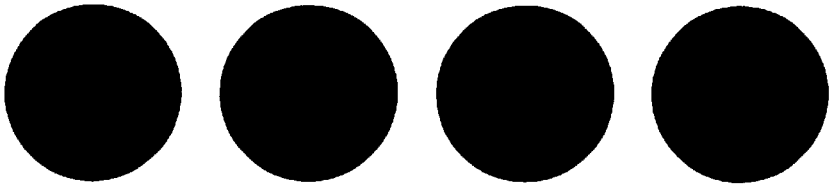
FIG. 5 is a diagram for illustrating the recording state of the dot in the first embodiment of a recording method of the thermal printer in accordance with the present invention.

By repeating the above-mentioned operation for each marker 10, the recorded area becomes approximately equal to the theoretical recorded area at all the recording positions and the recorded density becomes approximately equal to the theoretical recorded density at all the recording positions. As the result, the entire recorded area and the entire recorded density are equalized respectively at all the recording positions as shown in FIG. 5.

Therefore, according to the present embodiment, because the recorded area and the recorded density are equalized respectively at all the recording positions, the image of good quality with reduced jitter can be obtained.

Furthermore, according to the present embodiment, because the encoder 14 detects the marker 10 and the control unit 17 generates the head pulse simultaneously, a good quality image with reduced jitter can be recorded rapidly.

The case that the arithmetic unit 15 operates both the applied voltage and current flow time of the head pulse and the control unit 17 controls the head pulse based on both the applied voltage and current flow time is described in the above-mentioned embodiment, but the present embodiment is by no means limited to the case, and another case that the arithmetic unit 15 operates any one of the applied voltage and the current flow time of the head pulse and the control unit 17 controls the head pulse based on any one of the applied voltage and the current flow time may be applied.

In this case, in the first place, when the head pulse is controlled based on only the applied voltage, if the moving speed of the carriage 4 is faster than the theoretical speed at the N-th recording position, then the applied voltage $V_{N+1}$ is controlled so as to be larger than the theoretical applied voltage V at the (N+1)-th recording position. On the other hand, if the moving speed of the carriage 4 is slower than the theoretical speed at the N-th recording position, then the applied voltage $V_{N+1}$ is controlled so as to be smaller than the theoretical applied voltage V at the (N+1)-th recording position.

When the head pulse is controlled based on only the current flow time, if the moving speed of the carriage 4 is faster than the theoretical speed at the N-th recording position, then the current flow time $W_{N+1}$ is controlled so as to be shorter than the theoretical current flow time W at the (N+1)-th recording position. On the other hand, if the moving speed of the carriage 4 is slower than the theoretical speed at the N-th recording position, then the current flow time $W_{N+1}$ is controlled so as to be longer than the theoretical current flow time W at the (N+1)-th recording position.

As the result, in this case, any one of the recorded area and the recorded density is equalized each other at all the recording positions, and because by means of either methods the image with sufficiently reduced jitter is obtained, the approximately same effect as the above-mentioned embodiment can be obtained.

As described hereinbefore, according to the thermal printer and the recording method in accordance with the present invention, at least one of the recorded area and recorded density is equalized each other at all the recording positions, and the image of good quality with reduced jitter is obtained.

Next, the second embodiment of the present invention will be described in detail hereinafter with reference to FIG. 6 to FIG. 11.

Figure 7:
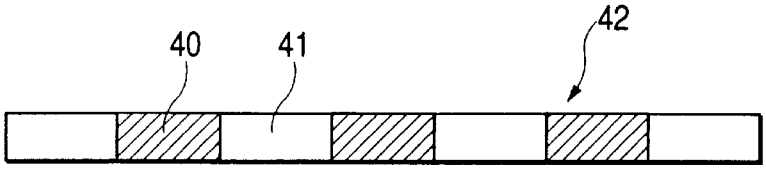
FIG. 7 is a diagram for illustrating a linear scale in the second embodiment of the thermal printer in accordance with the present invention.

A thermal printer 31 in the present embodiment is provided with a long flat plate shaped platen 32 at the desired position on a frame not shown in the drawing. Under the front of the platen 32, a carriage shaft 33 disposed in parallel to the platen 32 is provided, and the carriage shaft 33 supports a carriage 34 so as to be reciprocated slidably along a platen 32. At the position of the carriage that faces the platen 32, a thermal head 35 on which a plurality of heater elements are arranged is disposed so as to be on/off contactable on the platen 32. A driving belt 38 strung between a pair of pulleys 36 is fixed to one end of the carriage 34, and the driving belt 38 is structured so as to drive the carriage 34 along the platen 32 by means of the driving force of a carriage motor 39 such as a stepping motor connected to the pulleys 36. Behind the platen 32, a paper feeding means not shown in the drawing for feeding a recording paper between the platen 32 and the thermal head 35 is provided Under the platen 32, the linear scale 42 on which a plurality of markers 40 and blanks 41 are formed alternately and continuously with a plurality of predetermined intervals along the platen 32 shown in FIG. 7 is provided in parallel to the platen 32. The length of the respective markers 40 and the respective blanks 41 are all equal.

The encoder 44 for detecting a marker 40 of the linear scale 42 and generating the detection result as a pulse signal is provided on the carriage 34. The encoder 44 is provided with a light emitting element, not shown in the drawing, for emitting a light onto the linear scale 42 and a light receiving element, not shown in the drawing, for receiving a light reflected on the marker 40. Every time when the encoder 44 detects each marker 40, the encoder 44 generates the detection result as pulse signals intermittently.

Figure 8:
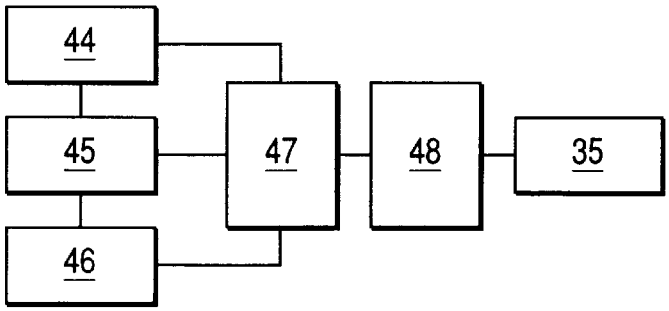
FIG. 8 is a block diagram for illustrating a recording control system in the second embodiment of the thermal printer in accordance with the present invention.

The thermal printer 31 is provided with a measurement unit 45 shown in FIG. 8. The measurement unit 45 measures the duty ratio $T_{ON}/T_{OFF}$ that is the ratio of the average value of the output time $T_{ON}$ to the average value of the non-output time $T_{OFF}$ of one pulse of the pulse signal obtained under the assumption that the speed of the carriage 34 is constant.

The measurement unit 45 is connected to an output correction arithmetic unit 46 for operating the output correction time of the head pulse based on the duty ratio measured by the measurement unit 45.

Furthermore, the thermal printer 31 is provided with a memory 47 for storing the encoder signal composed of the pulse signal and the output correction time.

The memory 47 is connected to a control unit 48 for correcting the output timing of the head pulse to be supplied to the heater elements based on the encoder signal and the output correction time stored in the memory 47. The control unit 48 recognizes the output state of the pulse signal as ON state, and supplies the ON head pulse that is synchronous with the output time of the pulse signal to the heater elements of the thermal head 35. Furthermore, the control unit 48 recognizes the non-output state of the pulse signal as OFF state, and supplies the OFF head pulse that is synchronous with the time delayed by the output correction time from the output ending time of the pulse signal to the heater elements of the thermal head 35.

Next, an embodiment of a recording method of the thermal printer 31 in accordance with the present invention to which the above-mentioned thermal printer 31 is applied is described.

Before starting of recording on a recording paper, the carriage 34 is moved to the right end from the left end by means of driving force of the carriage motor 39. At that time, the encoder 44 is driven to measure the duty ratio $T_{ON}/T_{OFF}$ that is the ratio of the average value of output time $T_{ON}$ to the average of non-output time $T_{OFF}$ of the pulse signal obtained under the assumption that the moving speed of the carriage 34 is constant.

The moving speed of the carriage 34 is proportional to the rotational speed of the carriage motor 39, and the rotational speed of the carriage motor 39 is generally constant excepting immediately after starting of rotation and immediately before stopping of rotation. Therefore, the moving speed of the carriage 34 is regarded to be constant excepting immediately after starting of motion and immediately before stopping of motion. To measure the duty ratio correctly, the encoder 44 may be driven in the range excepting immediately after starting of motion and immediately before stopping of motion of the carriage 34.

Figure 9:
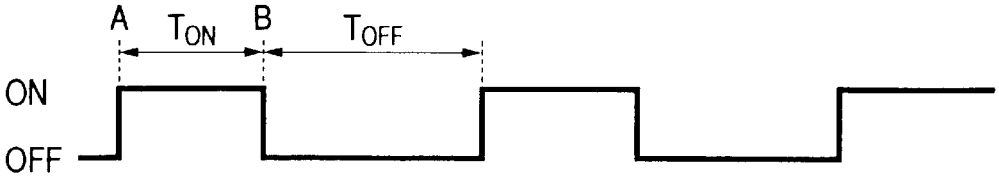
FIG. 9 is a time chart for describing the pulse signal generated from an encoder in the second embodiment of the recording method of the thermal printer in accordance with the present invention.
Figure 6:
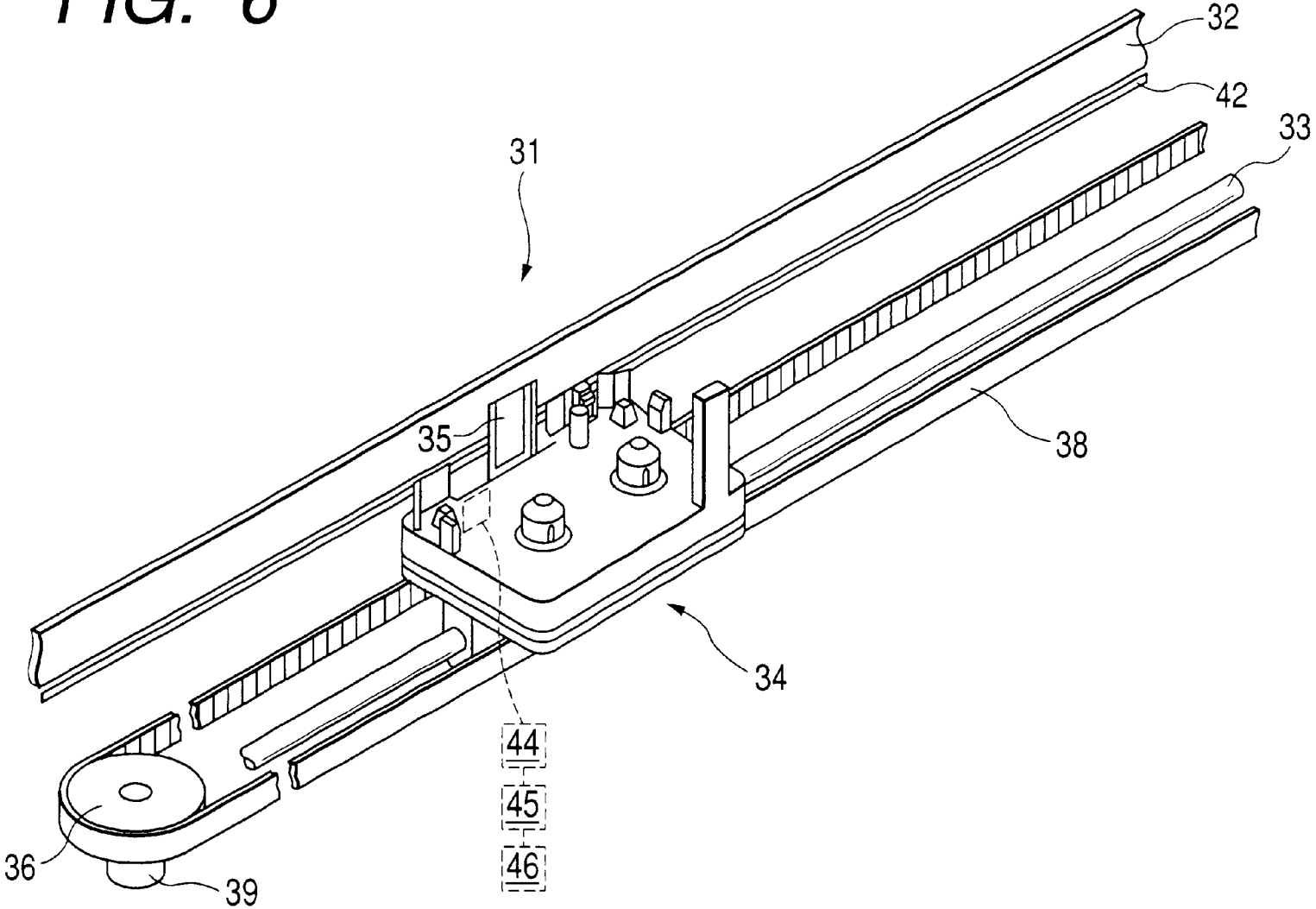
FIG. 6 is a perspective view for illustrating the second embodiment of a thermal printer in accordance with the present invention.

As the carriage 34 is moved, the encoder 44 detects respective markers 40 of the linear scale 42 successively, and generates the detection result as pulse signals intermittently. Because the encoder 44 does not detect the blank 41 of the liner scale 42, the encoder 44 does not generate the pulse signal when moving on the blank 41. The respective pulse signals generated by the encoder are components of a series of encoder signal as shown in FIG. 9.

When the encoder 44 detects the marker 40 of the linear scale 42, the measurement unit 45 measures the duty ratio $T_{ON}/T_{OFF}$ of the encoder signal of each pulse signal successively. The measurement unit 45 supplies a plurality of measured duty ratio data to the output correction time arithmetic unit 46.

The output correction time arithmetic unit 46 receives the plurality of duty ratio data and operates the average value of these duty ratios. The average value of duty ratios $T_{ON}/T_{OFF}$ obtained at that time is denoted by, for example, a/b. The correction arithmetic unit operates the output correction time of output timing of the OFF head pulse based on the average value a/b of the duty ratios as described herein under.

In the equation described herein under, $T_{ON}$ denotes the average output time of the encoder signal and $T_{OFF}$ denotes the average non-output time. X denotes the output correction time corresponding to the $T_{ON}$ and the $T_{OFF}$.

First, $T_{ON}+X=T_{OFF}-X$ . . . equation (3) holds. Because the average value of duty ratios is denoted by a/b, following approximation is possible.

$$T_{ON}/T_{OFF}=a/b \qquad \text{equation (4)}$$

Accordingly, from the equation (3) and the equation (4), $$X=\tfrac{1}{2}\times(b/a-1)T_{ON} \qquad \text{equation (5)}$$

Based on the equation (3), if $T_{OFF}>T_{ON}$, then $X>0$, and on the other hand, if $T_{OFF}<T_{ON}$, then $X<0$, the output correction time X may be positive or negative in the present invention. Accordingly, at the recording position where the output correction time X is negative, the output of the OFF head pulse is moved ahead substantially by the output correction time $|X|$. The above-mentioned arithmetic shows only a fundamental example, other various arithmetic may be applied to improve the accuracy of the output correction time X.

The encoder signal generated by the encoder 44 and the output correction time X data operated by the output correction time arithmetic unit 46 are stored in the memory 47.

Next, when the thermal head 35 prints a record on a recording paper on the platen 32, first a recording paper is fed between the printer and the thermal head 35 by means of a feeding means not shown in the drawing. The carriage motor 39 is driven to thereby move the carriage 34 along the platen 32.

Figure 10:
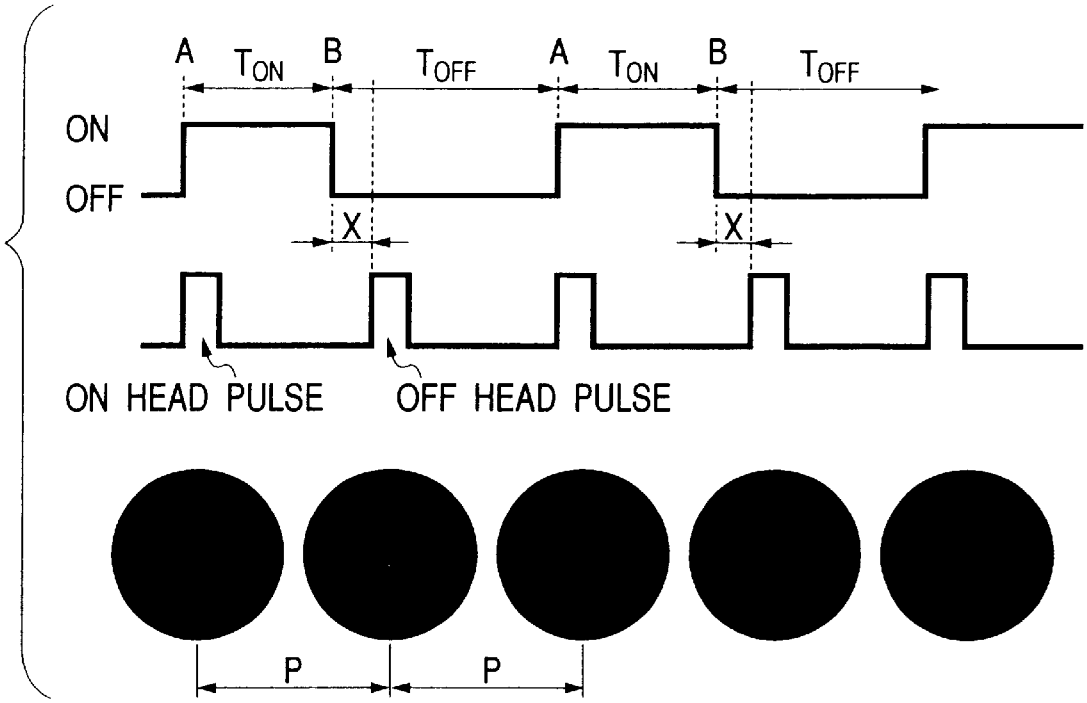
FIG. 10 is a time chart for describing the relation between the pulse signal and head pulse generated from the encoder in the second embodiment of the recording method of the thermal printer in accordance with the present invention.

At that time, the control unit 48 reads the encoder signal and the output correction time X data from the memory 47, and controls the output timing of the OFF head pulse to be supplied to the thermal head 35 based on these data. In detail, the control unit 48 supplies the ON head pulse to the heater elements of the thermal head 35 at the output starting time A of the pulse signal as shown in FIG. 10, and supplies the OFF head pulse to the heater elements of the thermal head 35 at the time B that delays by the output correction time X from the output ending time B of the pulse signal.

As the result, the head pulse is generated at intervals of an approximately constant time $(T_{ON}+T_{OFF})/2$, and the data is printed accurately at the timing of doubled resolution.

Therefore, according to the present embodiment, the output timing of the head pulse is obtained accurately at the timing of doubled resolution of the encoder 44, and the data is recorded on a recording paper with a constant dot pitch P.

The present invention is by no means limited to the above-mentioned embodiments, various modification may be applied as required.

Figure 11:
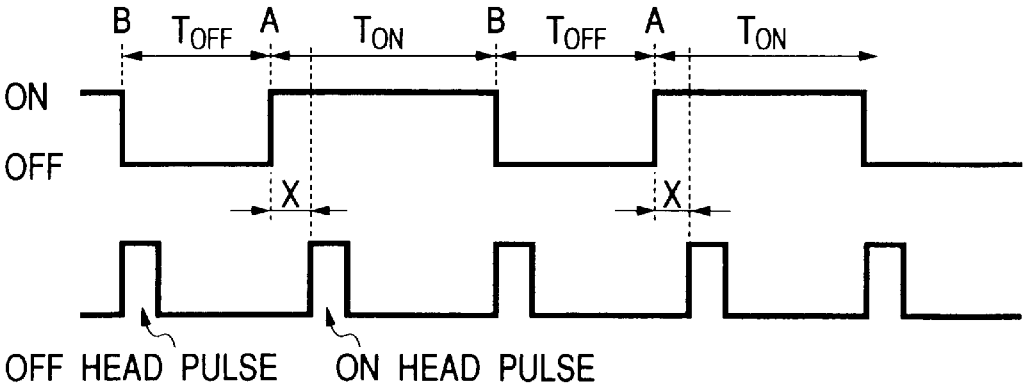
FIG. 11 is another exemplary time chart for describing the relation between the pulse signal and head pulse generated from the encoder in the second embodiment of the recording method of the thermal printer in accordance with the present invention.
Figure 12:
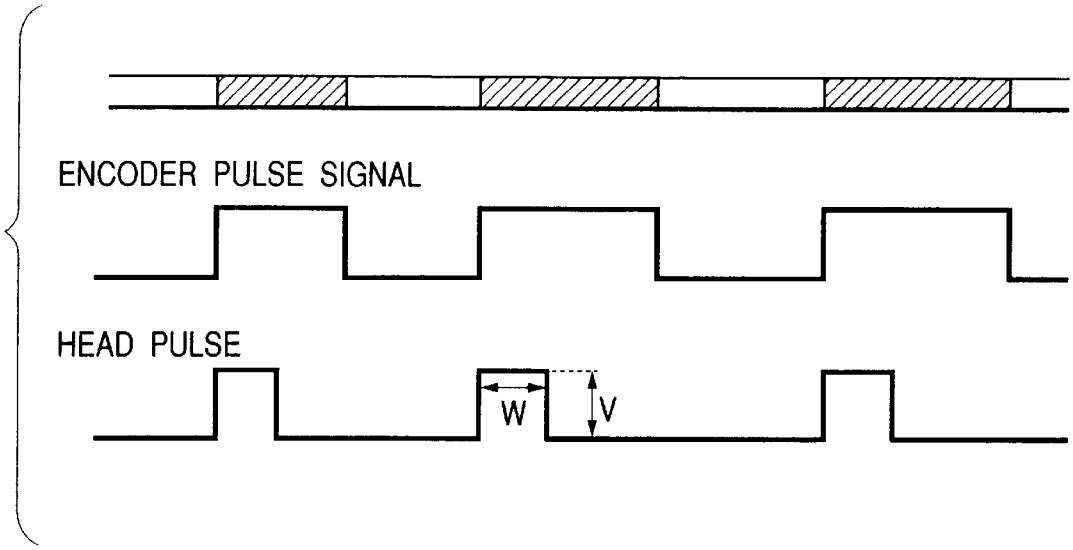
FIG. 12 PRIOR ART
FIG. 12 is a time chart for describing the relation between the pulse signal and head pulse generated from the encoder in recording by use of a conventional thermal printer.
Figure 13:
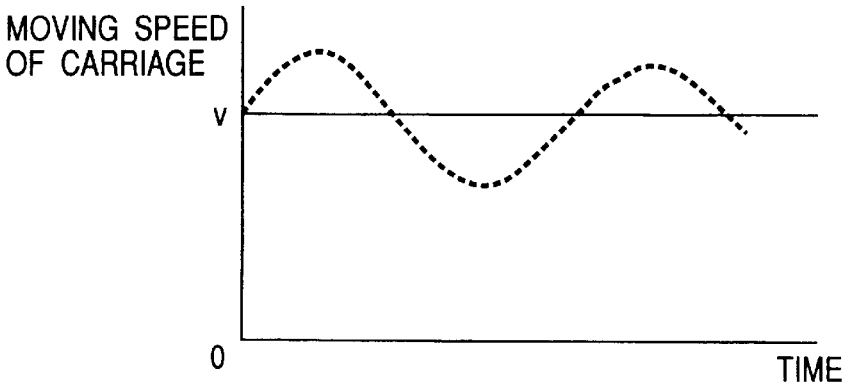
FIG. 13 PRIOR ART
FIG. 13 is a diagram for describing the moving speed of a carriage.
Figure 14:
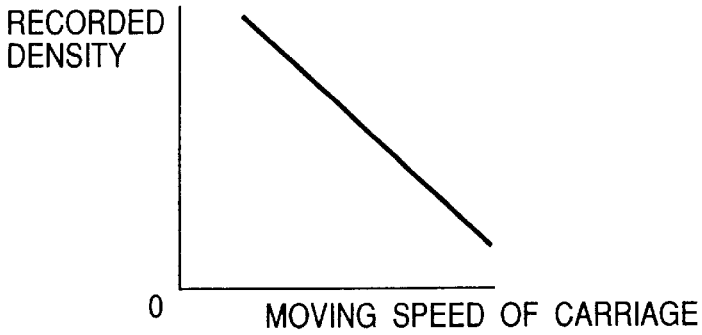
FIG. 14 PRIOR ART
FIG. 14 is a diagram for describing the relation between the moving speed of a carriage and the recorded density.
Figure 15:
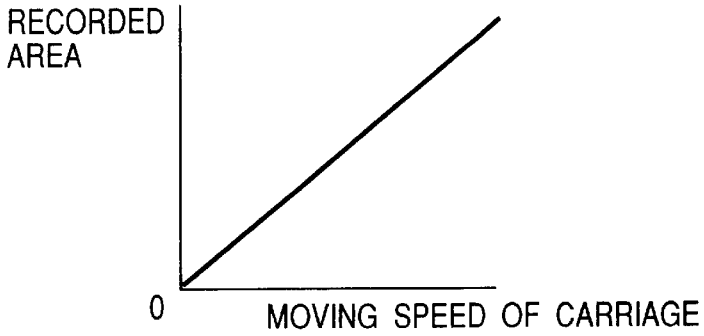
FIG. 15 PRIOR ART
FIG. 15 is a diagram for describing the relation between the moving speed of a carriage and the recorded area.
Figure 16:
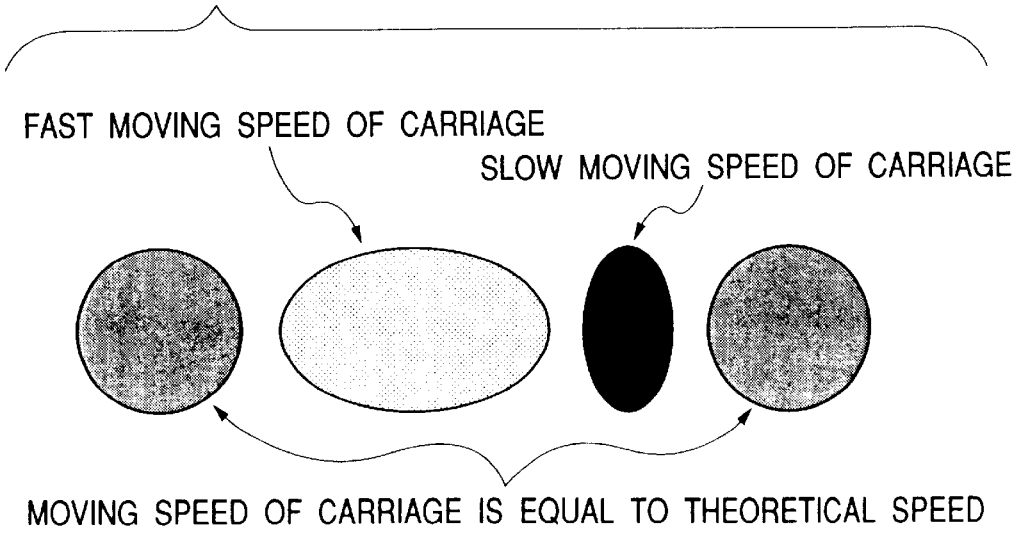
FIG. 16 PRIOR ART
FIG. 16 is a diagram for describing the recorded dot state in recording by use of a conventional thermal printer.
Figure 17:
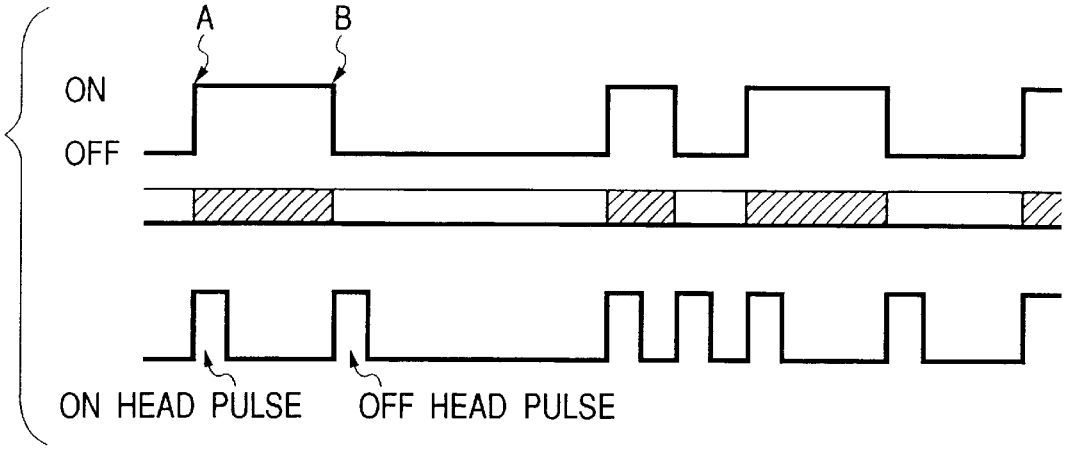
FIG. 17 PRIOR ART
FIG. 17 is a time chart for describing the relation between the pulse signal and head pulse generated from an encoder.
Figure 18:
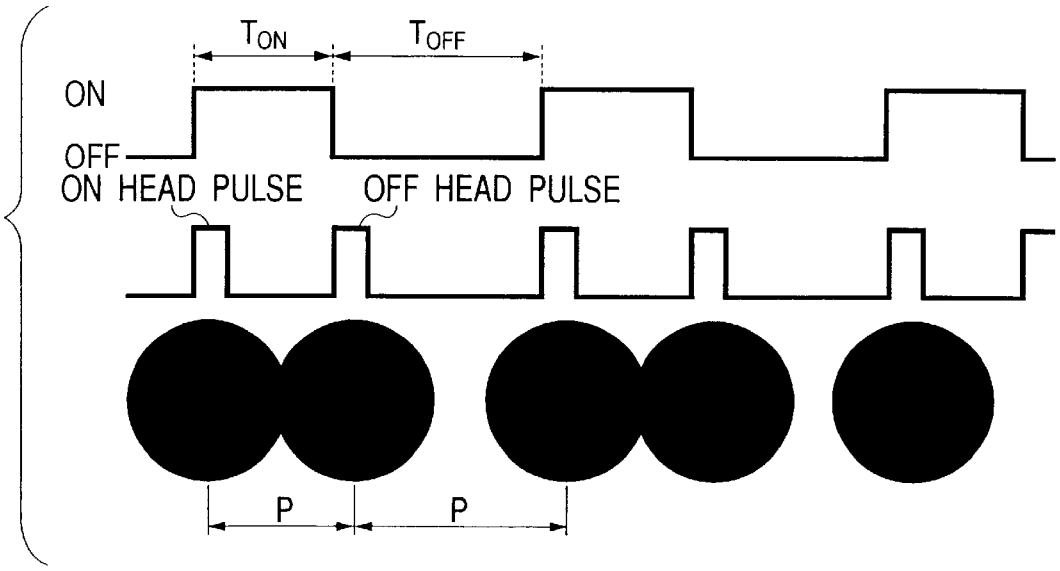
FIG. 18 PRIOR ART
FIG. 18 is a time chart for describing the time error caused in an encoder.
Figure 19:
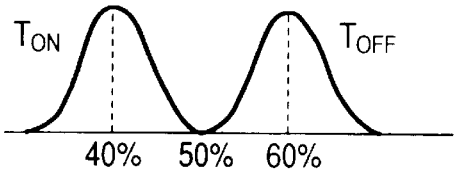
FIG. 19 PRIOR ART
FIG. 19 is a diagram for describing the distribution of the output time $T_{ON}$ and the non-output time $T_{OFF}$ of one dot of the pulse signal under an assumption that the moving speed of a carriage is constant.

For example, the case that the output starting time of the pulse signal is synchronized with the ON head pulse to thereby correct the output time of the OFF head pulse is described in the above-mentioned embodiment, but the present invention is by no means limited to this case, for example, another case that the output ending time of the pulse signal is synchronized with the OFF head pulse as shown in FIG. 11 to thereby correct the output time of the ON head pulse may be applied. The output timing of the head pulse can be made constant by means of the method described herein above, and the data is recorded on a recording paper with a constant dot pitch P.

The case that the encoder 44 detects the linear scale 42 once is described in the above-mentioned embodiment, but the detection may be repeated a plurality of times as required. In this case, because the number of duty ratios $T_{ON}/T_{OFF}$ supplied to the output correction time arithmetic unit 46 is multiplied by a factor corresponding to the number of repetition, the accuracy of the average value of duty ratios $T_{ON}/T_{OFF}$ and resultant output correction time X derived from the average value are improved.

As described hereinbefore, according to the thermal printer and the recording method that uses the thermal printer in accordance with the present invention, the output timing of the head pulse supplied to the heater elements of the thermal head is made constant, the data is recorded on a recording paper with a constant dot pitch, and a good quality image with reduced jitter is obtained.

What is claimed is:

1. A thermal printer comprising a carriage on which a plurality of heater elements are mounted supported so as to be reciprocated along a platen, a long linear scale on which markers and blanks are formed alternately and continuously along the platen disposed in parallel to the platen near the platen, an encoder to detect markers of the linear scale when the carriage is moved to generate pulse signals intermittently, and a control unit to generate and selectively supply an ON head pulse that is synchronous with an output starting time of the pulse signal and an OFF head pulse that is synchronous with an output ending time of the pulse signal to a plurality of heater elements of the thermal head, wherein;

a measurement unit to measure a duty ratio of an output time of the pulse signal to a non-output time of the pulse signal, and an output correction time arithmetic unit to operate an output correction time of an OFF head pulse from the duty ratio measured by the measurement unit are provided, and the control unit supplies the OFF head pulse to the heater elements at the time point that delays by the output correction time from the output ending time of the pulse signal.

2. The thermal printer of claim 1, wherein the output correction time is 0.5×(1/the duty ratio−1)×the output time of the pulse signal.

3. The thermal printer of claim 1, wherein the duty ratio is a ratio of an average output time of the pulse signal to an average non-output time of the pulse signal taken across the pulse signals for a constant moving speed of the carriage exclusive of a speed of the carriage immediately after starting of motion of the encoder and immediately before stopping of motion of the encoder.

4. The thermal printer of claim 3, wherein the average output time and average non-output time are determined from a single measurement of the linear scale.

5. The thermal printer of claim 3, wherein the average output time and average non-output time are determined from a plurality of measurements of the linear scale.

6. A thermal printer comprising a carriage on which a plurality of heater elements are mounted supported so as to be reciprocated along a platen, a long linear scale on which markers and blanks are formed alternately and continuously along the platen disposed in parallel to the platen near the platen, an encoder to detect markers of the linear scale when the carriage is moved to generate pulse signals intermittently, and a control unit to generate and selectively supply an OFF head pulse that is synchronous with an output ending time of the pulse signal and the ON head pulse that is synchronous with an output starting time of the pulse signal to a plurality of heater elements of the thermal head, wherein;

a measurement unit to measure a duty ratio of an output time of the pulse signal to a non-output time of the pulse signal and an output correction time arithmetic unit to operate an output correction time of the ON head pulse from the duty ratio measured by the measurement unit are provided, and the control unit supplies the ON head pulse to the heater elements at the time point that delays by the output correction time from the output starting time of the pulse signal.

7. The thermal printer of claim 6, wherein the output correction time is 0.5×(1/the duty ratio−1)×the output time of the pulse signal.

8. The thermal printer of claim 6, wherein the duty ratio is a ratio of an average output time of the pulse signal to an average non-output time of the pulse signal taken across the pulse signals for a constant moving speed of the carriage exclusive of a speed of the carriage immediately after starting of motion of the encoder and immediately before stopping of motion of the encoder.

9. The thermal printer of claim 8, wherein the average output time and average non-output time are determined from a single measurement of the linear scale.

10. The thermal printer of claim 8, wherein the average output time and average non-output time are determined from a plurality of measurements of the linear scale.

11. A recording method of a thermal printer to perform recording by use of a thermal head, comprising a carriage on which a plurality of heater elements are mounted supported so as to be reciprocated along a platen, a long linear scale on which markers and blanks are formed alternately and continuously along the platen disposed in parallel to the platen near the platen, an encoder to detect markers of the linear scale when the carriage is moved to generate pulse signals intermittently, and a control unit to generate and selectively supply an ON head pulse that is synchronous with an output starting time of the pulse signal and an OFF head pulse that is synchronous with an output ending time of the pulse signal to a plurality of heater elements of the thermal head, wherein;

a duty ratio of an output time of the pulse signal to a non-output time of the pulse signal generated by the encoder is measured, an output correction time of the OFF head pulse is operated from the measured duty ratio, and the OFF head pulse is supplied to the heater elements at a time point that delays by the output correction time from the output ending time of the pulse signal.

12. The recording method of claim 11, further comprising setting the output correction time to be 0.5×(1/the duty ratio−1)×the output time of the pulse signal.

13. The thermal printer of claim 11, further comprising computing a ratio of an average output time of the pulse signal to an average non-output time of the pulse signal taken across the pulse signals for a constant speed of the carriage excluding a speed of the carriage immediately after starting of motion of the encoder and immediately before stopping of motion of the encoder and setting the duty ratio to the ratio.

14. The thermal printer of claim 13, further comprising determining the average output time and average non-output time from a single measurement of the linear scale.

15. The thermal printer of claim 13, further comprising determining the average output time and average non-output time from a plurality of measurements of the linear scale.

16. A recording method of a thermal printer to perform recording by use of a thermal head, comprising a carriage on which a plurality of heater elements are mounted supported so as to be reciprocated along a platen, a long linear scale on which markers and blanks are formed alternately and continuously along the platen disposed in parallel to the platen near the platen, an encoder to detect markers of the linear scale when the carriage is moved to generate pulse signals intermittently, and a control unit to generate and selectively supply an OFF head pulse that is synchronous with an output ending time of the pulse signal and an ON head pulse that is synchronous with an output starting time of the pulse signal to a plurality of heater elements of the thermal head, wherein;

a duty ratio of an output time of the pulse signal to a non-output time of the pulse signal generated by the encoder is measured, an output correction time of the ON head pulse is operated from the measured duty ratio, and the ON head pulse is supplied to the heater elements at the time point that delays by the output correction time from the output ending time of the pulse signal.

17. The recording method of claim 16, further comprising setting the output correction time to be 0.5×(1/the duty ratio−1)×the output time of the pulse signal.

18. The thermal printer of claim 16, further comprising computing a ratio of an average output time of the pulse signal to an average non-output time of the pulse signal taken across the pulse signals for a constant speed of the carriage excluding a speed of the carriage immediately after starting of motion of the encoder and immediately before stopping of motion of the encoder and setting the duty ratio to the ratio.

19. The thermal printer of claim 18, further comprising the average output time and average non-output time from a single measurement of the linear scale.

20. The thermal printer of claim 18, further comprising determining the average output time and average non-output time from a plurality of measurements of the linear scale.

* * * * *